United States Patent [19]

Duruz

[11] Patent Number: 4,680,094

[45] Date of Patent: Jul. 14, 1987

[54] METHOD FOR PRODUCING ALUMINUM, ALUMINUM PRODUCTION CELL AND ANODE FOR ALUMINUM ELECTROLYSIS

[75] Inventor: Jean-Jacques Duruz, Geneva, Switzerland

[73] Assignee: ELTECH Systems Corporation, Boca Raton, Fla.

[21] Appl. No.: 829,436

[22] Filed: Feb. 13, 1986

[30] Foreign Application Priority Data

Feb. 18, 1985 [AT] Austria ..... 810064/85

[51] Int. Cl.[4] ..... C25C 3/12; C25C 7/02

[52] U.S. Cl. ..... 204/67; 204/243 R; 204/290 R

[58] Field of Search ..... 204/67, 243 R, 290 R

[56] References Cited

U.S. PATENT DOCUMENTS

| | | | |
|---|---|---|---|
| 3,960,678 | 6/1976 | Alder | 204/67 |
| 3,974,046 | 10/1976 | Alder | 204/67 |
| 4,187,155 | 2/1980 | de Nora et al. | 204/67 |
| 4,192,724 | 3/1980 | Minami et al. | 204/67 |
| 4,379,033 | 4/1983 | Clark et al. | 204/67 |
| 4,399,008 | 8/1983 | Ray | 204/67 |
| 4,504,369 | 3/1985 | Keller | 204/67 |

FOREIGN PATENT DOCUMENTS 0114085 7/1984 European Pat. Off. .

OTHER PUBLICATIONS

EP 85 810064, European Standard Search Report, dated 28 Oct. 1985.

*Primary Examiner*—John F. Niebling

*Attorney, Agent, or Firm*—John J. Freer

[57] ABSTRACT

A method of producing aluminum by electrolysis of alumina which is dissolved in a molten cryolite bath is described which uses a dimensionally stable anode comprising a substrate composed of a conductive ceramic, a cermet, a metal, an alloy, an intermetallic compound and/or carbon and a coating thereon comprising a rare earth metal oxide or a rare earth metal oxyfluoride which is preserved by maintaining a concentration of the rare earth metal in the electrolyte. By adding to the bath a contamination inhibiting agent the contamination of the aluminum by substrate components due to corrosion of the substrate by the electrolyte contacting the substrate at imperfections of the coating may be inhibited. The contamination inhibiting agent may be a compound of an alkali or an alkaline earth metal, such as a fluoride, in particular LiF or $MgF_2$.

19 Claims, No Drawings

METHOD FOR PRODUCING ALUMINUM, ALUMINUM PRODUCTION CELL AND ANODE FOR ALUMINUM ELECTROLYSIS

The invention relates to a method of producing aluminum by electrolysis of alumina dissolved in a molten cryolite bath using a dimensionally stable anode comprising a substrate which is unstable under the conditions of the aluminum electrolysis, said substrate being coated with a layer of a substance being substantially stable under said conditions and being preserved by maintaining a certain concentration of a component of the coating within the electrolyte. The invention further relates to an aluminum electrowinning cell comprising a dimensionally stable anode encompassing a substrate and a coating thereon, and a molten cyrolite bath. The invention finally relates to an anode for the electrolytic production of aluminum by electrolysis of an alumina containing bath of molten cryolite, the anode comprising a substrate and a coating thereon.

BACKGROUND ART

The European Patent Application 0 114 085 which was published on July 25, 1984 corresponding to U.S. Pat. No. 4,615,569, discloses a dimensionally stable anode for an aluminum production cell which anode comprises a substrate of a ceramic, a metal or other materials which is coated with a layer of a cerium oxycompound. The anode is stable under conditions found in an aluminum production cell, provided that a sufficient content of cerium is maintained in the electrolyte.

The anode as described in the above European Patent Application performs well with respect to dimensional stability, however, contamination of the aluminum by substrate components may occur under certain circumstances. As shown by microphotographs, the cerium-containing coating is in general comprises of a non-homogeneous structure leaving small interstices between coated areas, which provide access of the electrolyte to the substrate. In such cases, the electrolyte may corrode the substrate leading to a limited but undesired contamination of the aluminum by substrate components.

The French patent application 2 407 277 discloses a method of electrolyzing chlorides of e.g. magnesium, sodium, calcium or aluminum in electrolytes having temperatures between 500°-800° C. using an anode comprising a substrate and a coating of an oxide of a noble metal, whereby a certain concentration of an oxide or oxychloride of a metal which is more basic than the metal produced is maintained in the bath. Thus, by increasing the basicity of the bath the solubility of the anode coating is reduced.

This method provides better stability of the anode coating by the addition of melt additives. It relates to the stabilization and protection of the anode coating and not of the substrate as is one of the hereunder defined objects of the present invention. In the above patent application the substrate itself is stable in the chloride bath at the given operating temperature and is essentially protected by the coating.

In contrast, in a molten cyrolite bath at e.g. 960° C. an imperfect coating or substrate may not simply be protected against corrosion by modifying the basicity of the bath as described in the French patent but is unstable and corrodes. In a cyrolite bath, a mere modification of the basicity would not improve the stability of the substrate as it does with a coating of an oxide of a noble metal which is essentially stable in the described chloride bath of FR 2 407 277.

OBJECT OF THE INVENTION

It is one of the objects of the invention to provide a remedy for the above described contamination problem.

It is another object of the invention to provide a method of producing aluminum using a dimensionally stable anode comprising a coating with self-healing effect due to bath additions, whereby the contamination of the aluminum by substrate components is inhibited.

It is a further object of the invention to provide a simple technique for inhibiting the contamination of the aluminum by substrate components by a method which is simple to apply, which is not expensive and which does not require any modifications of the anode itself or of the cell.

SUMMARY OF THE INVENTION

The above and other objects are met by a method of producing aluminum by electrolysis of alumina dissolved in a molten cryolite bath using a dimensionally stable anode comprising a substrate which is unstable under the conditions of the aluminum electrolysis, said substrate being coated with a layer of a substance being substantially continuous and stable under said conditions and being preserved by maintaining a certain concentration of a component of the coating within the electrolyte, characterized by adding to the bath an agent for inhibiting contamination of the aluminum produced by substrate components diffusing through imperfections in the coating.

Dimensionally stable anodes to which the present invention is related comprise substrates which may be composed of a conductive ceramic, a cermet, a metal, an alloy, an intermetallic compound and/or carbon.

The coating may comprise a rare earth metal oxide or a rare earth metal oxyfluoride.

The contamination inhibiting agent may be a compound of an alkali or an alkaline earth metal, in particular a fluoride such as $MgF_2$ or LiF, the amount of which compared to the total bath composition may be in the range of 1–20 w % for $MgF_2$ and between 1–30 w % for LiF.

The above described method may be carried out in an aluminum electrowinning cell encompassing a dimensionally stable anode comprising a substrate which is unstable under the conditions of the aluminum electrolysis, said substrate being coated with a layer of a substance being substantially stable under said conditions and being preserved by maintaining a certain concentration of a component of the coating within an electrolyte, characterized by the electrolyte comprising an agent for inhibiting substrate components contamination of the aluminum produced by diffusion of substrate components through deficiencies of the coating.

Such an anode may comprise a substrate which is composed of a conductive ceramic, a cermet, a metal, an alloy, an intermetallic compound and/or carbon, a preferred substrate being e.g. $SnO_2$ or $SnO_2$-based materials such as described in U.S. Pat. No. 3,960,678 comprising sintered $SnO_2$ and small amounts of other oxides of e.g. Fe, Sb, Cu, Mn, Nb, Zn, Cr, Co and W. Other suitable substrates disclosed in U.S. Pat. No. 4,187,155 and 4,146,638 comprise a matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series; and at least one electroconductive agent selected from metallic yttrium, chromium, molybdenum, zirconium, tantalum, tungsten, cobalt, nickel, palladium and silver.

Generally the substrate may also be composed of an electroconductive body covered by a sub-coating of one of the above materials, in particular $SnO_2$ which in turn is covered by a coating which is substantially stable in the electrolyte.

The coating may be comprised of a rare earth metal oxide or oxyfluoride.

The contamination inhibiting barrier may be formed of a substance obtained by adding a contamination inhibiting agent into the bath, the contamination inhibiting agent being an alkali or an alkaline earth metal compound, in particular a fluoride such as $MgF_2$ or LiF.

The contamination inhibiting barrier may comprise $MgAl_2O_4$ particularly in form of a spinel.

DETAILED DESCRIPTION OF THE INVENTION

The dimensionally stable anodes to which the present invention is related are described in the European Patent Application 0 114 085, this document being referred to such as fully incorporated herein.

As mentioned under the heading "Background Art" the anode coatings comprised of e.g. cerium oxyfluoride remain stable but there may be a contamination of the aluminum by corrosion of the substrate to which the electrolyte finds limited access by small imperfections of the cerium-containing coating.

The principle on which the present invention is based lies in the employment of a contamination inhibiting agent, which per se or in form of a compound obtained by adding this agent into the electrolyte may infiltrate into the imperfections of the cerium or other rare earth metal coating to block channels, cracks, open pores and so forth so that contact of the cyrolite with the substrate is inhibited.

By doing so it is understood that the basic structure of the coating is not changed, only the voids which lead to the exposure of finite portions of the substrate are obstructed.

The maintenance of this contamination inhibiting barrier is assured by maintaining in the electrolyte a certain concentration of the agent which forms or produces this barrier.

Such agents must be non-reduceable by the cathode and may comprise alkali and/or alkaline earth metal compounds, in particular fluorides. Without limitation to a certain theory it is believed that, e.g. in the case of MgF2 as the contamination inhibiting agent, $MgAl_2O_4$ comprising a spinel structure precipitates within the voids of the anode coating, inhibiting the electrolyte from contacting the substrate.

Another possible explanation of the contamination inhibiting effect of the described agents may be the formation of complexes formed by the said agent and components of the substrate, these complexes forming a barrier along the coating-electrolyte interface comprising a high concentration of such complexes which inhibits access of the electrolyte to the substrate and thereby decreases further corrosion at endangered locations.

Other contamination inhibiting agents such as e.g. LiF may be used whereby it may be of advantage to employ substances which are not alien to the original contents of aluminum production cells. The concentration of these agents in the electrolyte depends on the nature of the specific agent, and may vary from a very small percentage for substances which are normally non-components of the electrolyte, to relatively high concentrations for substances which are already used in some cells for other reasons such as to modify properties of the electrolyte such as e.g. to increase the electrical conductivity of the electrolyte by addition of LiF.

The use of alkali or alkaline metal fluorides as contamination inhibiting agents was described by way of example. It to be understood that the invention is not restricted to the use of these agents or substances only. The scope of the invention and the accompanying claims covers any agent which leads to the obstruction of voids in a coating applied to the substrate of an anode, which is rendered dimensionally stable thereby under conditions of aluminum electrowinning cells.

EXAMPLES

EXAMPLE 1

In a test cell for electrolytic production of aluminum using an $SnO_2$ anode substrate in the shape of a cylinder with a semi-spherical lower end with dimensions: 12 mm diameter and 13 mm length, electrolysis was carried out for 30 hours at 960° C. The bath comprised a basic electrolyte of 88.8 w % $Na_3AlF_6$, 10 w % $Al_2O_3$ and 1.2 w % $CeF_3$ to which were added 20 w % LiF. The cathode was comprised by a 15 mm diameter and a 6.2 mm high disc of $TiB_2$, the total current was 1.8 A. The anodic and cathodic current densities were 0.4 $A/cm^2$.

After the electrolysis the substrate was coated with a 0.5 mm thick layer of cerium oxyfluoride, weighing 0.89 g. The produced aluminum was analyzed for contamination by the substrate, and a Sn concentration of smaller than 100 ppm was detected. Under the same electrolysis conditions with a cerium oxyfluoride coating but without the use of any LiF in the cryolite the Sn contamination in aluminum amounted to 1.0%.

EXAMPLE 2

In a bath comprising the same basic electrolyte of Example 1 to which were added 5 w % $MgF_2$ electrolysis was carried out at a temperature of 970° C. for 118 hours. The dimensions of the $SnO_2$ anode substrate were: 12.8 mm diameter by 21.6 mm length, the $TiB_2$ cathode dimensions were 18 mm diameter by 6.2 mm height. The total current was 1.8 A with anodic and cathodic current density of 0.25 $A/cm^2$.

After the electrolysis the Sn contamination in the aluminum was found to be 280 ppm. The coating was found to comprise a fissured layer of fluoride containing $CeO_2$ wherein the fissures were at least partially filled with $MgAl_2O_4$ of spinel structure. Under the same electrolysis conditions with a cerium oxyfluoride coating but without the use of any $MgF_2$ in the cryolite the Sn contamination in aluminum amounted to 1.5%.

I claim:

1. A method of producing aluminum by electrolysis of alumina dissolved in a molten cryolite bath using a dimensionally stable anode comprising a substrate which is unstable under the conditions of the aluminum electrolysis, said anode substrate having a coating layer having imperfections through which substrate components may diffuse, which method comprises providing as said coating layer on said anode substrate a layer containing cerium oxyfluoride that is substantially continuous and stable under said electrolysis conditions and that is preserved by maintaining cerium within the electrolyte, and supplying to said coating layer imperfections a substance supplied by providing one or more of an alkali or alkaline earth metal compound to said electrolyte, whereby contamination of product aluminum by anode substrate components diffusing through imperfections in the coating layer is inhibited.

2. The method of claim 1, characterized by providing an anode having a substrate composed of one or more of a conductive ceramic, a cermet, a metal, an alloy, an intermetallic compound or carbon coated with one or more of the foregoing.

3. The method of claim 1, characterized by providing an anode having a substrate composed of $SnO_2$ or a material comprising $SnO_2$ as a major component.

4. The method of claim 1, characterized by providing an anode having a sub-coating under said imperfect coating layer, with said sub-coating comprising $SnO_2$.

5. The method of claim 1, characterized by providing a compound of Mg or Li to said electrolyte.

6. The method of claim 5, characterized by the addition of $MgF_2$ in an amount of 1–20w% of the total bath composition.

7. The method of claim 5, characterized by the addition of LiF in an amount of 1–30w% of the total bath composition.

8. An aluminum electrowinning cell comprising a dimensionally stable anode immersed in a molted cryolite, the anode comprising a substrate which is unstable under the conditions of the aluminum electrolysis, said anode substrate being coated with a coating layer comprising cerium oxyfluoride and having imperfections through which substrate components may diffuse, said layer being substantially continuous and stable under said electrolysis conditions and being preserved by maintaining cerium within the electrolyte, with the coating layer imperfections containing a contamination inhibiting barrier substance, which barrier substance is provided by one or more of an alkali or alkaline earth metal compound in said electrolyte, whereby there is inhibited contamination of the aluminum produced by anode substrate components diffusing through imperfections in the coating layer.

9. The cell of claim 8, characterized by the anode substrate being composed of one or more of a conductive ceramic, a cermet, a metal, an alloy, an intermetallic compound or carbon coated with one or more of the foregoing.

10. The cell of claim 8, characterized by the substrate being composed of or coated with $SnO_2$ or a material comprising $SnO_2$ as a major component.

11. The cell of claim 10, characterized by the alkali or alkaline earth metal compound being a compound of Mg or Li.

12. The cell of claim 11, characterized by the addition of $MgF_2$ in an amount of 1–20 w % of the total bath composition.

13. The cell of claim 11, characterized by the addition of LiF in an amount of 1–30 w % of the total bath composition.

14. An anode for the electrolytic production of aluminum by electrolysis of an alumina containing electrolyte of molten cryolite, the anode comprising an anode substrate which is unstable under the conditions of the aluminum electrolysis, said anode substrate being coated with a coating layer comprising cerium oxyfluoride and having imperfections through which substrate components may diffuse, said layer being substantially continuous and stable under said electrolysis conditions and being preserved in use by maintaining a component of the coating within the electrolyte, and with the coating layer containing a contamination inhibiting barrier substance located within imperfections of the coating layer and provided by one or more of an alkali or alkaline earth metal compound in said electrolyte, whereby there is inhibited contamination of the product aluminum by anode substrate components diffusing through the imperfections of the coating layer.

15. The anode of claim 14, characterized by the substrate being composed of one or more of a conductive ceramic, a cermet, a metal, an alloy, an intermetallic compound or carbon coated with one or more of the foregoing.

16. The anode of claim 14, characterized by the substrate being composed of or coated with $SnO_2$ or a material comprising $SnO_2$ as a major component.

17. The anode of claim 19, characterized by the contamination inhibiting barrier substance comprising $MgAl_2O_4$.

18. An anode for the electrolytic production of aluminum by electrolysis of an alumina containing electrolyte of molten cryolite, the anode comprising:

an anode substrate which is unstable under the conditions of the aluminum electrolysis, said anode substrate being coated with a coating layer comprising cerium oxyfluoride, said coating layer being substantially continuous and stable under conditions of electrolysis for said alumina, with said coating layer being preserved by maintaining a component of the coating layer in the electrolyte, said coating layer having imperfections through which substrate components may diffuse and thereby containing, a contamination inhibiting barrier substance within imperfections in said coating layer, which substance comprises at least one alkali or alkaline earth metal aluminate for inhibiting contamination of electrolytic aluminum product by anode substrate components, the anode substrate being otherwise attacked through imperfections of said coating layer during electrolysis.

19. The anode of claim 19, wherein said anode substrate comprises stannic dioxide.

* * * * *